US008422896B2

(12) United States Patent
Isoda

(10) Patent No.: US 8,422,896 B2
(45) Date of Patent: Apr. 16, 2013

(54) IMAGE FORMING APPARATUS AND IMAGE FORMING METHOD CONFIGURED TO ADJUST TONER IMAGE DENSITY

(75) Inventor: Keisuke Isoda, Osaka (JP)

(73) Assignee: Kyocera Document Solutions, Inc., Osaka (JP)

( * ) Notice: Subject to any disclaimer, the term of this patent is extended or adjusted under 35 U.S.C. 154(b) by 284 days.

(21) Appl. No.: 12/851,924

(22) Filed: Aug. 6, 2010

(65) Prior Publication Data

US 2011/0052230 A1 Mar. 3, 2011

(30) Foreign Application Priority Data

Aug. 27, 2009 (JP) ..... 2009-197374

(51) Int. Cl.
*G03G 15/00* (2006.01)

(52) U.S. Cl.
USPC ..... 399/49; 399/53; 399/72

(58) Field of Classification Search ..... 399/49, 399/72
See application file for complete search history.

(56) References Cited

U.S. PATENT DOCUMENTS

| | | | | |
|---|---|---|---|---|
| 5,053,822 | A | 10/1991 | Butler | |
| 5,809,365 | A * | 9/1998 | Yoshizawa | 399/31 |
| 7,885,570 | B2 * | 2/2011 | Koie | 399/71 |
| 7,890,006 | B2 * | 2/2011 | Omelchenko et al. | 399/49 |
| 8,331,610 | B2 * | 12/2012 | Lin et al. | 382/100 |
| 2004/0057739 | A1 * | 3/2004 | Shimura | 399/49 |
| 2004/0141765 | A1 * | 7/2004 | Shimura et al. | 399/49 |
| 2004/0208661 | A1 * | 10/2004 | Kitagawa et al. | 399/49 |
| 2005/0100356 | A1 * | 5/2005 | Yang et al. | 399/49 |
| 2006/0165425 | A1 * | 7/2006 | Matayoshi et al. | 399/49 |
| 2009/0297191 | A1 * | 12/2009 | Hirai et al. | 399/49 |
| 2011/0158670 | A1 * | 6/2011 | Fuchimoto | 399/66 |

FOREIGN PATENT DOCUMENTS

| | | |
|---|---|---|
| JP | 06-011935 | 1/1994 |
| JP | 2005-338673 | 12/2005 |
| JP | 2007010915 A * | 1/2007 |

OTHER PUBLICATIONS

English machine translation of Japanese patent document Watanabe et al. (JP 2007-010915 A);; Authors: Watanabe, Masaru; and Isoda, Keisuke;; Title: "Method and Apparatus for Adjusting Toner Density for Image Forming Apparatus";; Publication Date: Jan. 18, 2007;; Application Date: Jun. 29, 2005.*

* cited by examiner

*Primary Examiner* — David Gray
*Assistant Examiner* — Geoffrey Evans
(74) *Attorney, Agent, or Firm* — Frommer Lawrence & Haug LLP

(57) ABSTRACT

An embodiment of an image forming apparatus may include a photosensitive member, a development unit, a transfer member, a sensor, and a correcting unit. The development unit may form a toner image on the photosensitive member. The toner image member may be transferred onto the transfer member. The sensor may detect light from a surface of the transfer member. The correcting unit may correct a toner density in a first area of the transfer member after transfer of a toner image of a test pattern to the first area. The correcting unit may correct the toner density on the basis of a difference between an output value of the sensor from a second area before the transfer of the toner image of the test pattern and an output value of the sensor from the second area after the transfer of the toner image of the test pattern.

18 Claims, 7 Drawing Sheets

Related Art

IMAGE FORMING APPARATUS AND IMAGE FORMING METHOD CONFIGURED TO ADJUST TONER IMAGE DENSITY

INCORPORATION BY REFERENCE

This application is based upon and claims the benefit of priority from the corresponding Japanese Patent application No. 2009-197374, filed Aug. 27, 2009, the entire content of which is incorporated herein by reference.

FIELD OF THE INVENTION

The present invention relates to an image forming apparatus and an image forming method.

BACKGROUND OF THE INVENTION

In an electrophotographic image forming apparatus, such as a printer, a copy machine, a facsimile machine, and a multifunction machine having the functions of these machines, the amount of toner (e.g., the toner density) contained in a toner image formed on a photosensitive member, such as a photosensitive drum, directly affects the quality of a printed image. The toner density varies in accordance with various conditions, such as the environment in which the image forming apparatus is used and also the duration of use. For example, when charging characteristics of a developing agent vary in accordance with a variation in the ambient environment, it becomes difficult for toner to reliably travel from a development unit to the photosensitive member if a constant developing bias is applied to the photosensitive member.

In addition, as the number of times an image forming process has been carried out increases, the thickness of a photosensitive layer on the photosensitive member decreases as a result of abrasion caused by contact with a cleaning blade for cleaning the photosensitive member or with an intermediate transfer member. Accordingly, it becomes difficult to maintain a constant surface potential of the photosensitive member. When the surface potential gradually decreases, the toner image density increases. As a result, the image quality becomes degraded.

In particular, in a tandem color image forming apparatus having a plurality of photosensitive members corresponding to colors arranged along a moving direction of an intermediate transfer member, there is a risk that an image having colors different from the desired colors will be formed.

To prevent this, some image forming apparatuses according to the related art adjust the toner image density as described below. As illustrated in FIGS. 1A and 1B, toner image 103 of a toner-density-adjustment image (e.g., a test pattern) is formed in predetermined area 102 of, for example, intermediate transfer belt 101 onto which a toner image formed on the photosensitive member is transferred first. The density of toner image 103 of the test pattern is measured by a sensor. The toner image density is adjusted by controlling process conditions, such as a developing bias voltage, in accordance with the result of the measurement. The test pattern includes, for example, areas in which the toner density changes stepwise.

The result of the measurement of the test pattern is affected by the reflectance of the background, that is, the reflectance of the surface of the intermediate transfer member in the area where the test pattern is to be formed. In the above-described tandem color image forming apparatus, the surface of the inter mediate transfer member, such as the intermediate transfer belt, comes into contact with, for example, a cleaning member and a transfer roller that transfers the toner image onto a recording medium, such as printing paper. Therefore, the surface of the intermediate transfer member is generally stained or scratched. In addition, a toner additive or the like adheres to the surface of the intermediate transfer member. Therefore, the measured toner density (as depicted in FIG. 1B) may be inaccurate. For this reason, a surface state of intermediate transfer member 101 before the formation of test pattern 103 (as shown in FIG. 1A) is measured in advance with the sensor, and the toner density is corrected on the basis of a sensor value obtained by the sensor.

The developing agent used for forming the toner image includes toner and a carrier. The toner additive, such as titanium oxide, is added to the toner. In the developing process for forming the toner image, a developing bias and a primary transfer bias are applied to the photosensitive member. At this time, some of the toner additive may be discharged separately from the toner and adhere to the surface of the intermediate transfer member.

In such a case, the toner additive adheres also to the background on which the test pattern is formed. Therefore, the reflectance and the like of the background cannot be accurately measured by the sensor and it becomes difficult to accurately measure the toner density.

SUMMARY OF THE INVENTION

An embodiment of an image forming apparatus may include a photosensitive member, a development unit, a transfer member, a sensor, and a correcting unit. The development unit may form a toner image on the photosensitive member. The toner image on the photosensitive member may be transferred to the transfer member. In some embodiments, the sensor may detect light from a surface of the transfer member. The correcting unit may correct a toner density in a first area of the transfer member after transfer of a toner image of a test pattern to the first area. In an embodiment, the correcting unit may correct the toner density on the basis of a difference between an output value of the sensor from a second area other than the first area before the transfer of the toner image of the test pattern to the first area and an output value of the sensor from the second area after the transfer of the toner image of the test pattern to the first area.

Some embodiments may include an image forming method utilizing various processes including, but not limited to, forming, transferring, detecting, and/or correcting. In an embodiment, in the forming process a toner image may be formed on a photosensitive member. During transferring, the toner image on the photosensitive member may be transferred onto a transfer member. Embodiments may include a detecting process in which light from a surface of the transfer member is detected with a sensor. In the correcting process, a toner density may be corrected at a first area of the transfer member after transfer of a toner image of a test pattern to the first area. The toner density may be corrected on the basis of a difference between an output value of the sensor from a second area other than the first area before the transfer of the toner image of the test pattern to the first area and an output value of the sensor from the second area after the transfer of the toner image of the test pattern to the first area.

The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize the disclosure are pointed out in particularity in the claims annexed to and forming a part of this disclosure. For a better understanding of the disclosure, its operating advantages and specific objects attained by its uses, reference is made to the accompanying descriptive matter in which embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF THE EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents. Embodiments of an image forming apparatus and image forming method will now be described in detail with reference to the drawings.

Figure 1A:
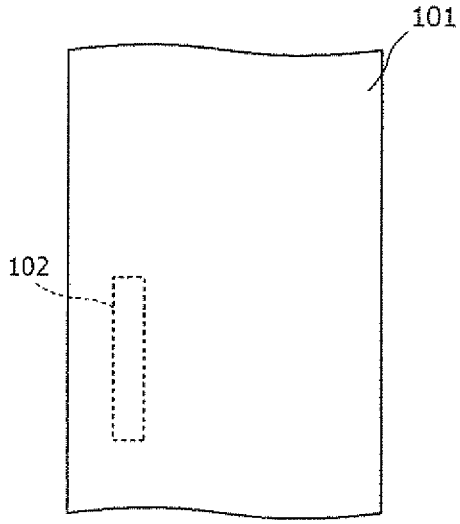
FIG.1A Related Art
FIGS. 1A and 1B are diagrams illustrating an example of an area at which reflected light is detected by a sensor in a toner density measurement process.
Figure 1B:
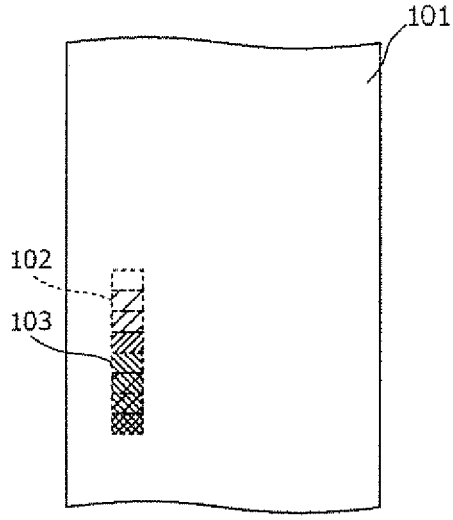
Figure 2:
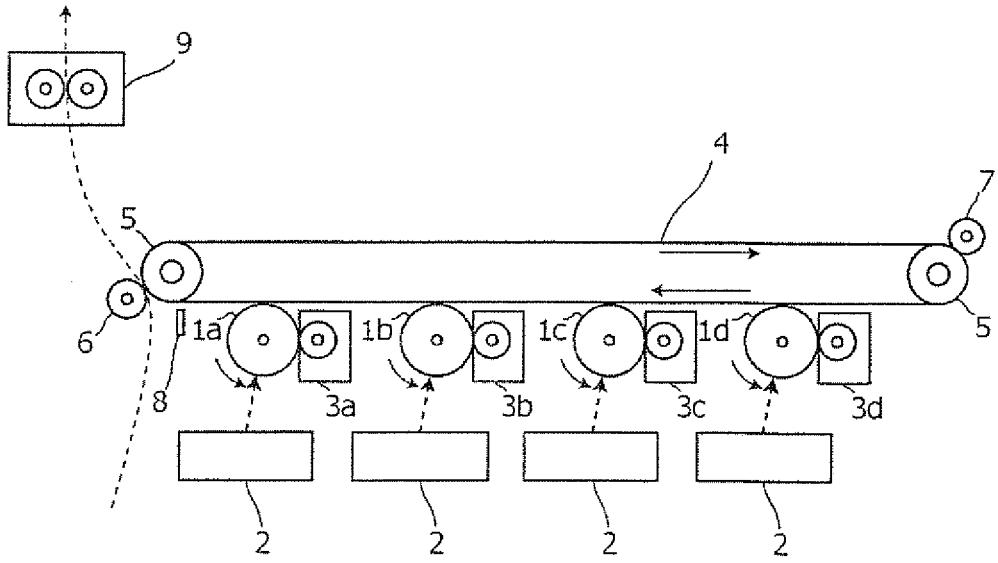
FIG. 2 is a side view illustrating a part of the inner mechanical structure of an image forming apparatus according to an embodiment.

FIG. 2 is a side view illustrating a part of the inner mechanical structure of an image forming apparatus according to an embodiment. The image forming apparatus may include, but is not limited to a printer, a facsimile machine, a copy machine, or a multifunction machine, that has a printing function.

According to an embodiment, the image forming apparatus may include a tandem color developing device. The color developing device may include one or more photosensitive drums, exposure devices, and/or development units. As depicted in FIG. 2, some embodiments include photosensitive drums 1*a*, 1*b*, 1*c*, 1*d*, exposure devices 2, and development units 3*a*, 3*b*, 3*c*, 3*d*. In some embodiments, photosensitive drums 1*a*, 1*b*, 1*c*, 1*d* are photosensitive members corresponding to four colors, for example, magenta, cyan, yellow, and black. Exposure devices 2 may irradiate the photosensitive drums 1*a*, 1*b*, 1*c*, 1*d* with light beams to form electrostatic latent images. In some embodiments, the exposure devices 2 include laser diodes, which are sources of the light beams, and optical elements (lenses, mirrors, polygonal mirrors, etc.) that guide the light beams to the respective photosensitive drums 1*a*, 1*b*, 1*c*, 1*d*.

In some embodiments, additional devices may be disposed around each of the photosensitive drums. For example, a charging device, such as a scorotron charging device, a cleaning device, a charge eliminating device, etc., may be disposed around each of the photosensitive drums 1*a*, 1*b*, 1*c*, 1*d*. The cleaning devices may remove toner that remains on the photosensitive drums 1*a*, 1*b*, 1*c*, 1*d* after a primary transfer process. In some embodiments, charge eliminating devices may reduce, and in some cases eliminate, electric charges on photosensitive drums 1*a*, 1*b*, 1*c*, 1*d* after the primary transfer process.

In some embodiments, development units 3*a*, 3*b*, 3*c*, 3*d* are filled with four colors of toner, for example, magenta, cyan, yellow, and black toner. Various embodiments may include fewer or more colors. In addition, the colors may include a broad range of colors beyond the colors listed here.

Development units 3*a*, 3*b*, 3*c*, 3*d* form toner images by supplying the toner to the electrostatic latent images formed on the photosensitive drums 1*a*, 1*b*, 1*c*, 1*d*, respectively. Developing agent, in some embodiments, may include toner, a carrier, and an additive, such as titanium oxide. For example, some embodiments may include an additive like titanium oxide added to the toner.

In an embodiment, colors of toner may be positioned in specific development units such that each corresponding colored image is formed at predetermined time and/or sequentially. For example, in some embodiments, a magenta image is formed by the photosensitive drum 1*d* and the development unit 3*d*. A cyan image is formed by the photosensitive drum 1*c* and the development unit 3*c*. A yellow image is formed by the photosensitive drum 1*b* and the development unit 3*b*. A black image is formed by the photosensitive drum 1*a* and the development unit 3*a*.

In various embodiments, intermediate transfer belt 4 is a loop-shaped image bearing member that is in contact with photosensitive drums 1*a*, 1*b*, 1*c*, 1*d*. Toner images on photosensitive drums 1*a*, 1*b*, 1*c*, 1*d* may be transferred to a surface of inter mediate transfer belt 4. In some embodiments, intermediate transfer belt 4 is an example of a transfer member. As shown in FIG. 2, intermediate transfer belt 4 may be stretched between driving rollers 5 and may be rotated by the driving force of driving rollers 5 in a direction from the position of contact with photosensitive drum 1*d* to the position of contact with photosensitive drum 1*a*.

As shown in FIG. 2, various embodiments may include transfer roller 6 which causes a paper sheet to be conveyed in a manner to cause the paper sheet to contact intermediate transfer belt 4. The toner image may then be transferred from intermediate transfer belt 4 to the paper sheet. As is depicted in FIG. 2, the paper sheet onto which the toner image has been transferred is then conveyed to fixing device 9, where the toner image on the paper sheet may be fixed.

In some embodiments, roller 7 is provided with a cleaning brush. Roller 7 brings the cleaning brush into contact with intermediate transfer belt 4 to remove toner that remains on intermediate transfer belt 4 after the toner image is transferred onto the paper sheet.

As FIG. 2 depicts, various embodiments include sensor 8. In some embodiments, sensor 8 may include a light source and/or a light receiving element. For example, sensor 8 may irradiate intermediate transfer belt 4 with a light beam, and may detect reflected light. In a toner-density adjusting process, sensor 8 irradiates a predetermined area of intermediate transfer belt 4 with the light beam, detects the reflected light, and outputs an electric signal corresponding to the amount of the detected light.

Figure 3:
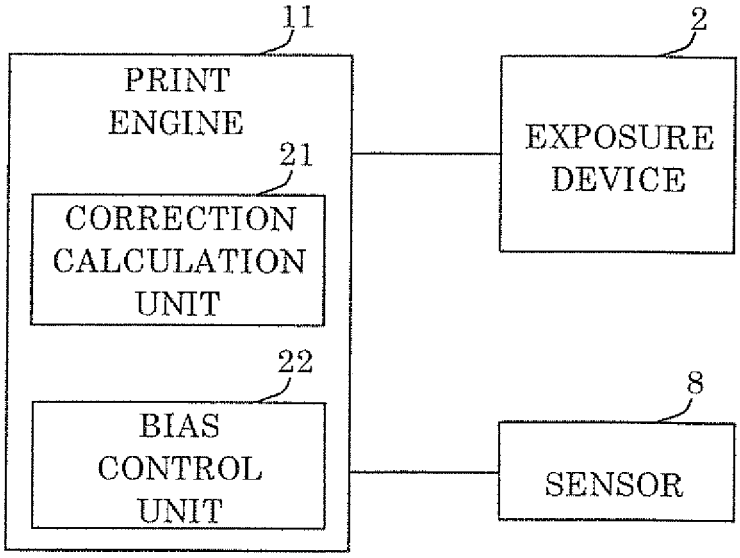
FIG. 3 is a block diagram illustrating a part of the electrical structure of the image forming apparatus according to the embodiment.

FIG. 3 is a block diagram illustrating a part of the electrical structure of the image forming apparatus according to an embodiment. In FIG. 3, print engine 11 is a processing circuit that carries out an operation of feeding a paper sheet, performing printing on the paper sheet, and ejecting the paper sheet by controlling a drive source (not shown). The drive source drives the above-described rollers, a bias-applying circuit that applies a developing bias and a primary transfer bias, and exposure devices 2. The developing bias is applied between photosensitive drums 1*a*, 1*b*, 1*c*, 1*d* and the respective development units 3*a*, 3*b*, 3*c*, 3*d*, and the primary transfer bias is applied between the intermediate transfer belt 4 and the photosensitive drums 1*a*, 1*b*, 1*c*, 1*d*.

In various embodiments, print engine 11 includes correction calculation unit 21 and a bias control unit 22.

In some embodiments, correction calculation unit 21 determines a difference between output values of sensor 8 when measuring a value from a reference area (i.e., second area). Output values at the reference area may be measured before and after the transfer of a toner image of a test pattern to the test pattern area (i.e., first area) of intermediate transfer belt 4. Then, the correction calculation unit 21 calculates a toner density in the test pattern area after the transfer of the toner image of the test pattern while correcting the toner density on the basis of the determined difference between the output values of the reference area (second area) before the transfer of the toner image 63 of the test pattern and after the transfer of the toner image 63 of the test pattern. Correction calculation unit 21 is an example of a correction unit. As described below with reference to FIGS. 6A and 6B, the first area corresponds to a test pattern area 62 and the second area corresponds to a reference area 61.

Output values from the sensors refer to the values measured by the sensor and may include, but are not limited to measurements of light.

In some embodiments, bias control unit 22 controls the developing bias applied to each of photosensitive drums 1*a*, 1*b*, 1*c*, 1*d* and the primary transfer bias applied to intermediate transfer belt 4. In various embodiments, bias control unit 22 starts applying the developing bias and the primary transfer bias after light from the second area is detected by sensor 8 before the toner image of the test pattern is transferred to the first area.

Figure 4:
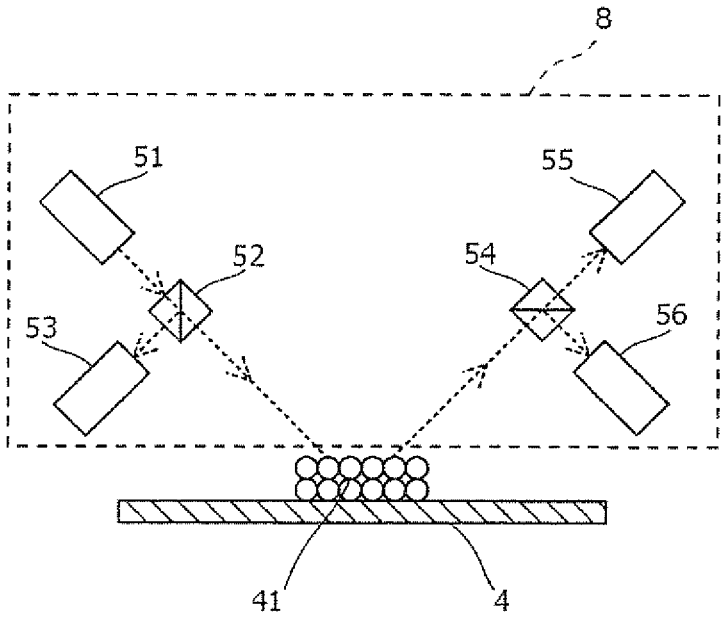
FIG. 4 is a diagram illustrating a density measurement process performed by a sensor illustrated in FIG. 2.

FIG. 4 is a diagram illustrating the density measurement process performed by sensor 8 illustrated in FIG. 2.

As illustrated in FIG. 4, sensor 8 includes light source 51 that emits a light beam, light-source-side beam splitter 52, light-source-side light-receiving element 53, light-receiving-side beam splitter 54, first light-receiving element 55, and second light-receiving element 56. In some embodiments, sensors may include a combination of one or more light sources, light-source-side beam splitters, light-source-side light-receiving elements, light-receiving-side beam splitters, first light-receiving elements, and/or second light-receiving elements.

In some embodiments, light sources may include, but are not limited to light-emitting diodes (such as laser diodes), any light sources known in the art, and/or a combination thereof. Various embodiments may include beam splitters including, but not limited to polarizing beam splitters, linear polarizers, absorptive polarizers, any device capable of splitting a beam of light in two and/or any device capable of transmitting only light of a pre-determined polarization state. For example, in an embodiment a beam splitter may transmit a p-polarized component of the light beam from the light source and reflect an s-polarized component of the light beam of the light beam from the light source. In some embodiments, a light-source-side light-receiving element may include, but is not limited to a photodetector such as a photodiode, and may comprise one or more discrete photodetectors and/or at least one photodetector array (e.g., linear or two-dimensional), which in some implementations may be configured to measure color (e.g., colorimetry).

In some embodiments, light source 51 is, for example, a light-emitting diode. As shown in FIG. 4, beam splitter 52 transmits a p-polarized component of the light beam emitted from light source 51 and reflects an s-polarized component of the light beam emitted from light source 51. According to an embodiment, light-source-side light-receiving element 53 is, for example, a photodiode. The light-source-side light-receiving element 53 detects the s-polarized component reflected by beam splitter 52 and outputs an electric signal corresponding to the amount of the detected light. In some embodiments, this electric signal may be used for stabilization control of light source 51.

FIG. 4 illustrates that the p-polarized component that passes through light-source-side beam splitter 52 is incident on a surface (e.g., toner image 41 or background) of intermediate transfer belt 4, and is reflected by the surface. The reflected light includes a regular reflection component and a diffuse reflection component. The regular reflection component is p-polarized.

In some embodiments, beam splitter 54 transmits a p-polarized component (i.e., the regular reflection component) of the reflected light and reflects an s-polarized component of the reflected light. FIG. 4 depicts light-receiving element 55 as a photodiode. Light-receiving element 55 detects the p-polarized component that has passed through beam splitter 54, and outputs an electric signal corresponding to the amount of the detected light. Light-receiving element 56 is, for example, a photodiode. Light-receiving element 56 detects the s-polarized component reflected by beam splitter 54 and outputs an electric signal corresponding to the amount of the detected light.

As shown in FIG. 3, correction calculation unit 21 calculates the toner density while determining a correction amount for correcting the toner density on the basis of the output from light-receiving element 55 and the output from light-receiving element 56.

Various embodiments, conditions utilized during the toner density correction process may vary. Conditions which may be pre-determined include, but are not limited to the linear velocity of the intermediate transfer belt, the circumferential length of the intermediate transfer belt, the sampling rate of output from the sensor, the sampling time of output from sensor in first revolution, and the sampling time of output from sensor in second revolution.

In some embodiments, the following conditions may have the illustrative pre-determined values listed below during the toner density correction process:

Linear velocity of intermediate transfer belt: about 164 mm/sec

Circumferential length of intermediate transfer belt: about 760 mm

Sampling rate of output from sensor 8: about 4.0 msec

Sampling time of output from sensor 8 in first revolution: about 4.7 sec

Sampling time of output from sensor 8 in second revolution: about 4.7 sec

Figure 5:
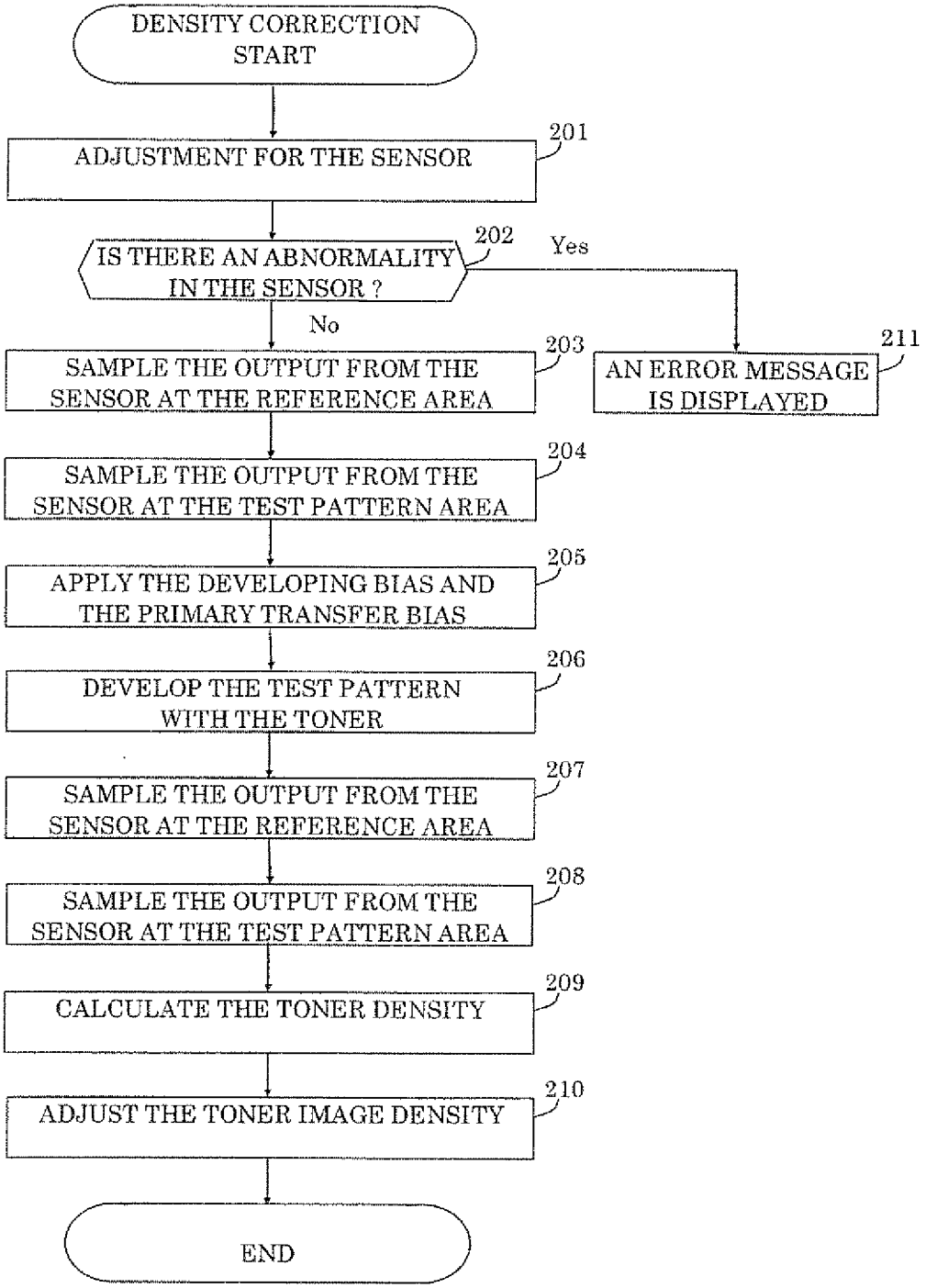
FIG. 5 is a flowchart of a toner density correction process performed by the image forming apparatus illustrated in FIGS. 1 and 2.

FIG. 5 is a flowchart of the toner density correction process performed by the image forming apparatus illustrated in FIGS. 2 and 3.

First, the print engine 11 operates the sensor 8 to perform light-amount adjustment for the sensor 8, and determines whether or not there is an abnormality in the sensor 8 (201 and 202). If there is no abnormality in the sensor 8, the print engine 11 performs the following.

First, the print engine 11 causes the driving rollers 5 to rotate the intermediate transfer belt 4. Then, the correction calculation unit 21 samples output values from the sensor 8 at predetermined areas on the surface of the intermediate transfer belt 4.

Figure 6A:
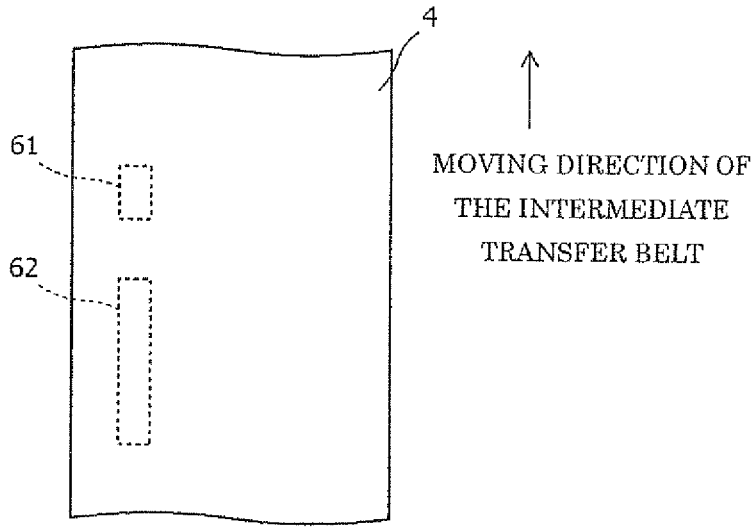
FIGS. 6A and 6B are diagrams illustrating examples of areas at which reflected light is detected by the sensor in the toner density correction process illustrated in FIG. 5.
Figure 6B:
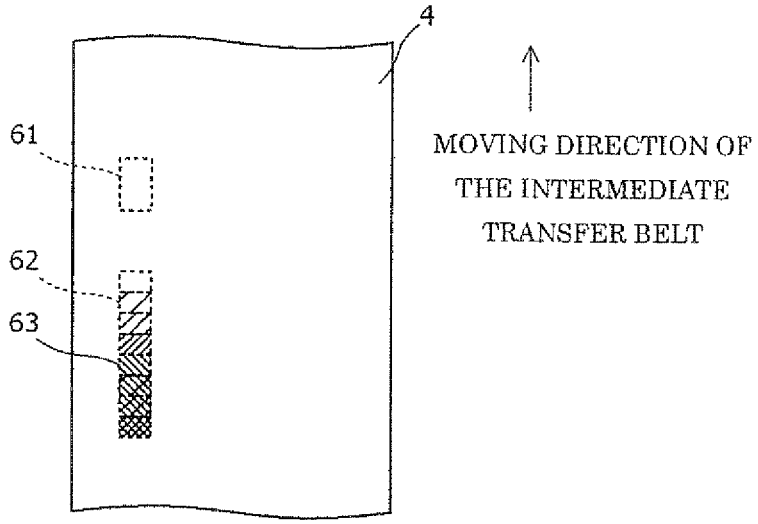

FIGS. 6A and 61B are diagrams illustrating examples of the areas at which the reflected light is detected by the sensor 8 in the toner density correction process illustrated in FIG. 5. As illustrated in FIGS. 6A and 6B, reference area (i.e., second area) 61 and test pattern area (i.e., first area) 62 are set on the surface of the intermediate transfer belt 4. In an embodiment, reference area 61 is positioned 20 mm ahead of test pattern area 62 in the moving direction of the intermediate transfer belt 4. As described below, toner image 63 of a test pattern is formed in test pattern area 62.

As described in FIG. 5, during a first revolution of the intermediate transfer belt, correction calculation unit samples the output from the sensor at the reference area (203) and the output from the sensor at the test pattern area (204) before the formation of the toner image of the test pattern in the test pattern area. Thus, referring to FIG. 2 and FIG. 3, in a first revolution of intermediate transfer belt (e.g., intermediate transfer belt 4 shown in FIG. 2), correction calculation unit (e.g., correction calculation unit 21 shown in FIG. 3) samples the output from sensor (e.g., sensor 8) at reference area (e.g., reference area 61 shown in FIG. 2) and the output from sensor (e.g., sensor 8) at test pattern area (e.g., test pattern area 62) before the formation of toner image (e.g., toner image 63) of the test pattern in test pattern area (e.g., test pattern area 62 shown in FIG. 6A). Since the developing process using the toner has not yet been performed, the outputs from the sensor (e.g., sensor 8) correspond to the reflectance of the background at both the reference area (e.g., reference area 61) and the test pattern area (e.g., test pattern area 62).

FIG. 5 illustrates that the bias control unit (e.g., bias control unit 22) applies the developing bias and the primary transfer bias to the photosensitive drums (205), and develops the test pattern with the toner (206). More specifically, toner images of respective colors are formed on the photosensitive drums (e.g., photosensitive drums 1*a*, 1*b*, 1*c*, 1*d*), and are transferred onto the intermediate transfer belt (e.g., intermediate transfer belt 4), so that the toner image (e.g., toner image 63) of the test pattern is formed. In some embodiments, the test pattern may include, for example, areas having different toner densities for each color.

In a second revolution of the intermediate transfer belt, the correction calculation unit samples the output from the sensor at the reference area (207) and the output from the sensor at the test pattern area (208) after the formation of the toner image of the test pattern in the test pattern area. Referring to FIG. 2 for orientation of the component parts, in a second revolution of intermediate transfer belt 4, correction calculation unit 21 (shown in FIG. 3) samples the output from sensor 8 at reference area 61 and the output from sensor 8 at test pattern area 62 after the formation of toner image 63 of the test pattern in test pattern area 62 (FIG. 6B).

Figure 7:
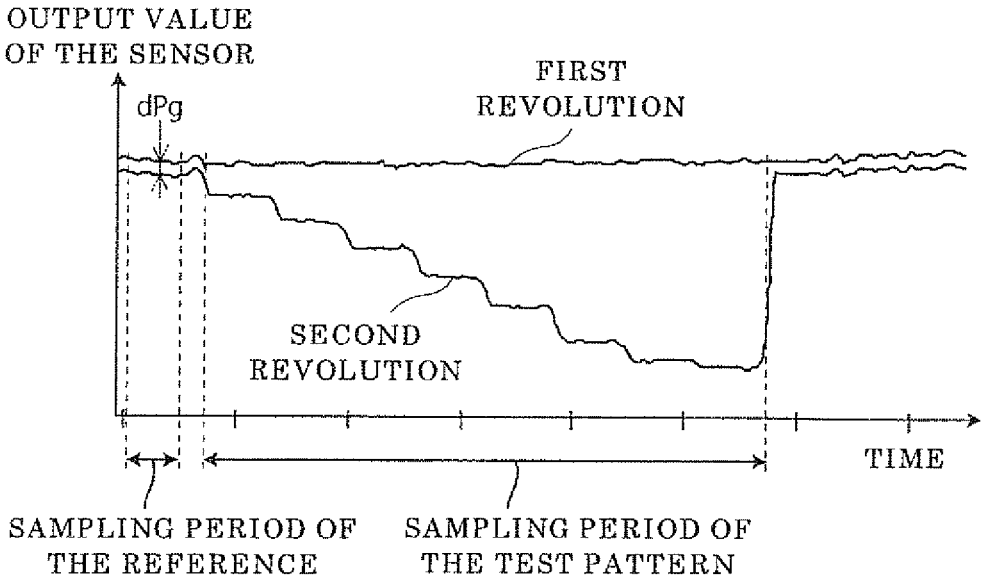
FIG. 7 is a graph illustrating examples of waveforms output from the sensor in the toner density correction process illustrated in FIG. 5.

FIG. 7 is a graph illustrating examples of waveforms output from sensor 8 in the toner density correction process illustrated in FIG. 5. As illustrated in FIG. 7, in the first revolution of intermediate transfer belt 4, the output value of sensor 8 from reference area 61 (See FIG. 5, 203) and the output value of sensor 8 from test pattern area 62 (See FIG. 5, 203) are substantially equal to each other since toner image 63 has not yet been formed in test pattern area 62. In the second revolution of intermediate transfer belt 4, toner image 63 is formed in test pattern area 62. The reflectance decreases as the toner density increases. Therefore, the output value of sensor 8 from test pattern area 62 (See FIG. 5, 208) is lower than the output value of sensor 8 from reference area 61 (See FIG. 5, 207). In addition, in this example, the overall sensor output level in the second revolution is lower than the overall sensor output level in the first revolution. In some embodiments this may result from the additive being discharged from development units 3*a*, 3*b*, 3*c*, 3*d* separately from the toner as a result of the application of the developing bias and the primary transfer bias, and being carried by the photosensitive drums 1*a*, 1*b*, 1*c*, 1*d* so as to adhere to the surface of intermediate transfer belt 4 by electrostatic induction. As a result, the sensor output level at the area free from toner image 63 (for example, reference area 61) in the second revolution becomes lower than that in the first revolution.

As described above and outlined in the flowchart depicted in FIG. 5, correction calculation unit 21 (shown in FIG. 3) samples the output from sensor 8 (shown in FIG. 2) at reference area 61 and the test pattern area 62 (shown in FIGS. 6A-6B) before and after the test pattern is developed with the toner. Then, the correction calculation unit 21 determines a difference between the output value of the sensor 8 from the reference area 61 before the transfer of the toner image 63 of the test pattern and the output value of the sensor 8 from the reference area 61 after the transfer of the toner image 63 of the test pattern. Then, the correction calculation unit 21 calculates the toner density in the test pattern area 62 after the transfer of the toner image 63 of the test pattern while correcting the toner density on the basis of the determined difference (209).

For example, the correction calculation unit 21 may calculate the toner density ("CTD") as follows:

$$CTD = \left(1 - \frac{(P - P0) - (S - S0)}{(Pg - dPg - P0) - (Sg - S0)}\right) \times 1000 \quad (1)$$

The toner density CTD is expressed by the output value P from light-receiving element 55 (that is, the regular reflection component) at test pattern area 62 after the formation of toner image 63, the output value S from light-receiving element 56 (that is, the diffuse reflection component) at test pattern area 62 after the formation of toner image 63, a dark potential output value P0 of light-receiving element 55, a dark potential output value S0 of light-receiving element 56, the output value Pg from light-receiving element 55 (that is, the regular reflection component) at test pattern area 62 before the formation of toner image 63, the output value Sg from light-receiving element 56 (that is, the diffuse reflection component) at test pattern area 62 before the formation of toner image 63, and the amount of correction dPg corresponding to the change in the output of sensor 8 (which may be caused by the additive). Here, dPg can be calculated as dPg=Pg1−P1 where Pg1 is the output value from light-receiving element 55 at reference area 61 before the formation of the toner image 63 and P1 is the output value from light-receiving element 55 at reference area 61 after the formation of toner image 63.

In this embodiment, the toner density is measured while taking the amount of correction dPg into account.

Thus, correction calculation unit 21 measures the toner density, and then adjusts the toner image density in accordance with the measured toner density by changing the process conditions, such as the developing bias voltage as shown in FIG. 5 (210).

If it is determined that there is an abnormality in sensor 8 at 202 in FIG. 5, an error message is displayed on an operation panel (not shown) and the process is terminated (211).

As described above, according to some embodiments, correction calculation unit 21 determines a difference between the output value of sensor 8 from reference area 61 before the transfer of toner image 63 of the test pattern and the output value of sensor 8 from reference area 61 after the transfer of toner image 63 of the test pattern. Then, correction calculation unit 21 corrects the toner density in test pattern area 62 after the transfer of toner image 63 of the test pattern on the basis of the determined difference.

Therefore, even if the additive of the toner adheres to the intermediate transfer belt 4, the toner density can be accurately measured.

The present invention is not limited to the above-described embodiment, and various modifications and changes are possible within the scope of the present invention.

Some embodiments may also be applied to a monochrome image forming apparatus.

According to some embodiments, sensor 8 may be a reflective sensor. Various embodiments may include a transmissive sensor as sensor 8, provided that it is implemented in accordance with the structure of the intermediate transfer member.

Transfer members may include, but are not limited to belts, transfer belts, intermediate transfer belts and/or any transfer members known in the art

Having thus described in detail embodiments of the present invention, it is to be understood that the invention described by the foregoing paragraphs is not to be limited to particular details and/or embodiments set forth in the above description, as many apparent variations thereof are possible without departing from the scope of the present invention.

What is claimed is:

1. An image forming apparatus configured to adjust toner image density, comprising:

a photosensitive member;

a development unit configured to form a toner image on the photosensitive member;

a transfer member onto which the toner image on the photosensitive member is transferred;

a sensor configured to detect light from a surface of the transfer member; and a correcting unit configured to correct a toner density in a first area of the transfer member after transfer of a toner image of a test pattern to the first area, the correcting unit operable to correct the toner density on the basis of a difference between an output value of the sensor corresponding to light detection from a second area of the transfer member other than the first area before the transfer of the toner image of the test pattern to the first area and an output value of the sensor corresponding to light detection from the second area after the transfer of the toner image of the test pattern to the first area, wherein, when the toner image of the test pattern is transferred to the first area, the toner image of the test pattern is not transferred to the second area.

2. The image forming apparatus according to claim 1, wherein the correcting unit is configured to correct the toner density in the first area based on subtracting the difference from the output value of the sensor corresponding to light detection from the first area before the transfer of the toner image of the test pattern to the first area.

3. The image forming apparatus according to claim 1, further comprising:

a bias control unit configured to control a developing bias applied to the photosensitive member and a transfer bias applied to the transfer member, and wherein the bias control unit is configured to start applying the developing bias and the transfer bias after light from the second area is detected by the sensor before the toner image of the test pattern is transferred to the first area.

4. The image forming apparatus according to claim 1, wherein toner used to form the toner image includes an additive.

5. The image forming apparatus according to claim 4, wherein the additive is titanium oxide.

6. The image forming apparatus according to claim 1, wherein the sensor is a reflective density sensor configured to irradiate the first area and the second area with light and detect reflected light from the first area and the second area.

7. The image forming apparatus according to claim 6, wherein the sensor includes a first light-receiving element that detects a regular reflection component of the reflected light and a second light-receiving element that detects a diffuse reflection component of the reflected light, and wherein the correcting unit determines the toner density on the basis of an output from the first light-receiving element and an output from the second light-receiving element.

8. The image forming apparatus according to claim 1, wherein the transfer member comprises a loop-shaped intermediate transfer belt configurable to transfer the toner image to a recording medium.

9. The image forming apparatus according to claim 1, wherein the test pattern includes areas having different toner densities for each color.

10. The image forming apparatus according to claim 1, wherein the second area is smaller than the first area.

11. The image forming apparatus according to claim 1, wherein the second area is adjacent to the first area in the moving direction of the transfer member.

12. The image forming apparatus according to claim 11, wherein the second area is positioned about 20 mm ahead of the first area in the moving direction of the transfer member.

13. An image forming method configured to adjust toner image density, comprising:

forming a toner image on a photosensitive member;

transferring the toner image on the photosensitive member onto a transfer member;

detecting light from a surface of the transfer member with a sensor; and correcting a toner density in a first area of the transfer member after transfer of a toner image of a test pattern to the first area, the toner density being corrected on the basis of a difference between an output value of the sensor corresponding to light detection from a second area of the transfer member other than the first area before the transfer of the toner image of the test pattern to the first area and an output value of the sensor corresponding to light detection from the second area after the transfer of the toner image of the test pattern to the first area, wherein, when the toner image of the test pattern is transferred to the first area, the toner image of the test pattern is not transferred to the second area.

14. The image forming method according to claim 13, wherein the correcting of the toner density in the first area comprises subtracting the difference from an output value of the sensor corresponding to light detection from the first area before the transfer of the toner image of the test pattern to the first area.

15. The image forming method according to claim 13, further comprising:

controlling a developing bias applied to the photosensitive member and a transfer bias applied to the transfer member, and wherein applying the developing bias and the transfer bias is started after light from the second area is detected by the sensor before the toner image of the test pattern is transferred to the first area.

16. The image forming method according to claim 13, wherein the second area is smaller than the first area.

17. The image forming method according to claim 13, wherein the second area is adjacent to the first area in the moving direction of the transfer member.

18. The image forming method according to claim 17, wherein the second area is positioned about 20 mm ahead of the first area in the moving direction of the transfer member.

* * * * *